US008157553B2

(12) United States Patent
Yamazaki et al.

(10) Patent No.: US 8,157,553 B2
(45) Date of Patent: Apr. 17, 2012

(54) SCROLL COMPRESSOR HAVING A SHIFTED GRAVITY CENTER

(75) Inventors: Hiroshi Yamazaki, Aichi (JP); Makoto Takeuchi, Aichi (JP); Takahide Ito, Aichi (JP); Takamitsu Himeno, Aichi (JP); Tetsuzou Ukai, Aichi (JP); Kazuhide Watanabe, Aichi (JP); Katsuhiro Fujita, Aichi (JP); Tomohisa Moro, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 499 days.

(21) Appl. No.: 12/442,002

(22) PCT Filed: Nov. 29, 2007

(86) PCT No.: PCT/JP2007/073039

§ 371 (c)(1),
(2), (4) Date: Mar. 19, 2009

(87) PCT Pub. No.: WO2008/066105

PCT Pub. Date: Jun. 5, 2008

(65) Prior Publication Data

US 2010/0021328 A1 Jan. 28, 2010

(30) Foreign Application Priority Data

Nov. 29, 2006 (JP) ..... 2006-322312

(51) Int. Cl.

| | |
|---|---|
| ***F01C 21/10*** | (2006.01) |
| ***F03C 2/00*** | (2006.01) |
| ***F03C 4/00*** | (2006.01) |
| ***F04C 2/00*** | (2006.01) |

(52) U.S. Cl. ..... 418/150; 418/55.1; 418/55.2

(58) Field of Classification Search ..... 418/55.1–55.6, 418/57, 150

See application file for complete search history.

(56) References Cited

U.S. PATENT DOCUMENTS

| | | | | |
|---|---|---|---|---|
| 3,874,827 | A * | 4/1975 | Young | 418/55.2 |
| 3,884,599 | A * | 5/1975 | Young et al. | 418/55.2 |
| 4,457,674 | A * | 7/1984 | Kawano et al. | 418/55.2 |
| 6,494,695 | B1 * | 12/2002 | Lifson | 418/55.2 |
| 2006/0171830 | A1 * | 8/2006 | Takei | 418/55.2 |

FOREIGN PATENT DOCUMENTS

| | | | |
|---|---|---|---|
| JP | 58110886 | A * | 7/1983 |
| JP | 63061786 | A * | 3/1988 |
| JP | 64-63683 | A | 3/1989 |
| JP | 8-247051 | A | 9/1996 |
| JP | 8-338375 | A | 12/1996 |
| JP | 2002-89464 | A | 3/2002 |

OTHER PUBLICATIONS

International Search Report of PCT/JP2007/073039, Mailing Date of Feb. 26, 2008.

* cited by examiner

*Primary Examiner* — Theresa Trieu
(74) *Attorney, Agent, or Firm* — Westerman, Hattori, Daniels & Adrian, LLP

(57) ABSTRACT

In a scroll compressor, a center of a turning scroll body is shifted with respect to a drive central axis so that a distance between a gravity center and the drive central axis in a turning scroll becomes smaller than a predetermined allowable value set based on theoretical displacement and mass of the turning scroll. A moment force about the drive central axis acting on the turning scroll is reduced during revolving, and an alternating force acting on an autorotation preventing pin in the turning scroll is reduced to an allowable level.

6 Claims, 10 Drawing Sheets

SCROLL COMPRESSOR HAVING A SHIFTED GRAVITY CENTER

TECHNICAL FIELD

The present invention relates to a scroll compressor, and more particularly relates to structures of components that form a scroll compressor.

BACKGROUND ART

A scroll compressor generally includes a fixed scroll fixed to a housing and in which a scroll wall (hereinafter, "fixed scroll body") is placed upright on a surface of an end plate of the fixed scroll, and a turning scroll in which a scroll wall (hereinafter, "turning scroll body") having a substantially identical shape to the fixed scroll body is placed upright on a surface of an end plate of the turning scroll. The fixed scroll and the turning scroll are arranged in the housing in a state in which the surfaces of the end plates mutually face each other and the turning scroll body is engaged with the fixed scroll body. Thus, in the scroll compressor, a crescent shaped compression space is formed between the fixed scroll and the turning scroll.

The scroll compressor can gradually reduce the volume of the compression space to compress fluid in the compression space by driving the turning scroll so as to revolve with respect to the fixed scroll and moving the compression space formed between the scroll bodies from the outer circumferential side to a central side of the scroll bodies.

As for this type of scroll compressor, to prevent the turning scroll from rotating around a drive central axis during driving of the turning scroll, there is known a technology for preventing rotation of the turning scroll by providing a pin and a ring on the end plate of the turning scroll and on a housing opposed to the end plate respectively and engaging these devices (for example, see Patent document 1).

In the scroll compressor provided with autorotation preventing pin and ring, when the turning scroll is revolving, the pin provided in either one of the turning scroll and the housing comes in contact with an inner surface of the ring provided in the other one to move. This movement allows prevention of the turning scroll from autorotation with respect to the fixed scroll and also allows revolution of the turning scroll.

Patent document 1: Japanese Patent Application Laid-Open No. H8-338375

DISCLOSURE OF INVENTION

Problem to be Solved by the Invention

However, in the scroll compressor, the drive central axis of the turning scroll does not often pass through a gravity center of the turning scroll. The shape of the scroll body of the turning scroll is not often a point symmetric shape with respect to the center of the scroll body such as a shape along an involute curve of a circle. Therefore, if the center of the scroll body is set on the drive central axis of the turning scroll, a misalignment may occur between the gravity center and the drive central axis of the turning scroll. For example, when the scroll body has a shape similar to the involute curve of the circle and if the center of an involute base circle is set on the drive central axis, a misalignment occurs between the gravity center and the drive central axis of the turning scroll.

In the scroll compressor in which there is misalignment between the gravity center of the turning scroll and the drive central axis thereof, by revolving the turning scroll, a moment force acting mainly on the drive central axis of the turning scroll turns in a reverse direction during revolving. At this time, force, so-called "alternating force", alternately changing its direction in a circumferential direction of the drive central axis acts on between autorotation preventing pins arranged around the drive central axis of the turning scroll and rings. If the alternating force acting on the autorotation preventing pin is large, then the pin fatigues, which may cause its strength to decrease.

It is an object of the present invention to provide a scroll compressor with reliability which is improved by reducing force acting on an autorotation preventing pin.

Means for Solving Problem

According to an aspect of the present invention, a scroll compressor includes: a fixed scroll in which a fixed scroll body being a scroll wall is placed upright on an end plate; a turning scroll in which a turning scroll body being a scroll wall is placed upright on an end plate, the turning scroll forming a compression space in a state in which the turning scroll body is engaged with the fixed scroll body; and a plurality of pins for allowing the turning scroll to revolve with respect to the fixed scroll while preventing the turning scroll from an autorotation around a center of a drive central axis. A center of the turning scroll body is set so that a distance between a center of gravity and the drive central axis in the turning scroll becomes smaller than a predetermined allowable value set based on a theoretical displacement volume and a mass of the turning scroll.

Advantageously, in the scroll compressor, the center of the turning scroll body is shifted with respect to the drive central axis.

Advantageously, in the scroll compressor, a concave is formed in an outer surface of an outermost circumferential portion of the turning scroll body.

Advantageously, in the scroll compressor, a concave is formed along an outer edge of the end plate of the turning scroll.

According to another aspect of the present invention, a scroll compressor includes: a fixed scroll in which a fixed scroll body being a scroll wall is placed upright on an end plate; a turning scroll in which a turning scroll body being a scroll wall is placed upright on an end plate, the turning scroll forming a compression space in a state in which the turning scroll body is engaged with the fixed scroll body; and a plurality of pins for allowing the turning scroll to revolve with respect to the fixed scroll while preventing the turning scroll from an autorotation around a center of a drive central axis. A concave is formed in an outer surface of an outermost circumferential portion of the turning scroll body so that a distance between a center of gravity and the drive central axis in the turning scroll becomes smaller than a predetermined allowable value set based on a theoretical displacement volume and a mass of the turning scroll.

According to still another aspect of the present invention, a scroll compressor includes: a fixed scroll in which a fixed scroll body being a scroll wall is placed upright on an end plate; a turning scroll in which a turning scroll body being a scroll wall is placed upright on an end plate, the turning scroll forming a compression space in a state in which the turning scroll body is engaged with the fixed scroll body; and a plurality of pins for allowing the turning scroll to revolve with respect to the fixed scroll while preventing the turning scroll from an autorotation around a center of a drive central axis. A concave is formed along an outer edge of the end plate of the turning scroll so that a distance between a center of gravity and the drive central axis in the turning scroll becomes smaller than a predetermined allowable value set based on a theoretical displacement volume and a mass of the turning scroll.

Effect of the Invention

According to the scroll compressor of the present invention, the center of the turning scroll body is set so that a distance between a center of gravity and the drive central axis in the turning scroll becomes smaller than a predetermined allowable value set based on a theoretical displacement volume and a mass of the turning scroll. Therefore, a moment force about the drive central axis acting on the turning scroll can be reduced during revolving, and the alternating force acting on the autorotation preventing pin can be reduced to an allowable level. As a result, the reliability of the scroll compressor can be improved.

According to the scroll compressor of the present invention, the center of the turning scroll body is shifted with respect to the drive central axis. Therefore, the moment force about the drive central axis acting on the turning scroll can be reduced during revolving, and the alternating force acting on the autorotation preventing pin can be reduced to an allowable level without changing the outer shape of the turning scroll body.

According to the scroll compressor of the present invention, the concave is formed in the outer surface of the outermost circumferential portion of the turning scroll body. Therefore, a predetermined location of the outermost circumferential portion in the circumferential direction is reduced in weight, and the gravity center of the turning scroll can be brought close to the drive central axis. This enables to reduce the moment force about the drive central axis acting on the turning scroll during revolving and to reduce the alternating force acting on the autorotation preventing pin.

According to the scroll compressor of the present invention, the concave is formed along the outer edge of the end plate in the turning scroll. Therefore, the gravity center of the turning scroll can be brought close to the drive central axis without changing the shape of the turning scroll body. This enables to reduce the moment force about the drive central axis acting on the turning scroll during revolving and to reduce the alternating force acting on the autorotation preventing pin.

According to the scroll compressor of the present invention, the concave is formed in the outer surface of the outermost circumferential portion of the turning scroll body while the center of the turning scroll body is shifted with respect to the drive central axis so that the distance between the gravity center and the drive central axis in the turning scroll becomes smaller than the predetermined allowable value. Therefore, the moment force about the drive central axis acting on the turning scroll can be reduced during revolving, and the alternating force acting on the autorotation preventing pin can be reduced to an allowable level. As a result, the reliability of the scroll compressor can be improved.

According to the scroll compressor of the present invention, the concave is formed along the outer edge of the end plate in the turning scroll while the center of the turning scroll body is shifted with respect to the drive central axis so that the distance between the gravity center and the drive central axis in the turning scroll becomes smaller than the predetermined allowable value. Therefore, the moment force about the drive central axis acting on the turning scroll can be reduced during revolving, and the alternating force acting on the autorotation preventing pin can be reduced to an allowable level. As a result, the reliability of the scroll compressor can be improved.

EXPLANATIONS OF LETTERS OR NUMERALS

Figure 1:
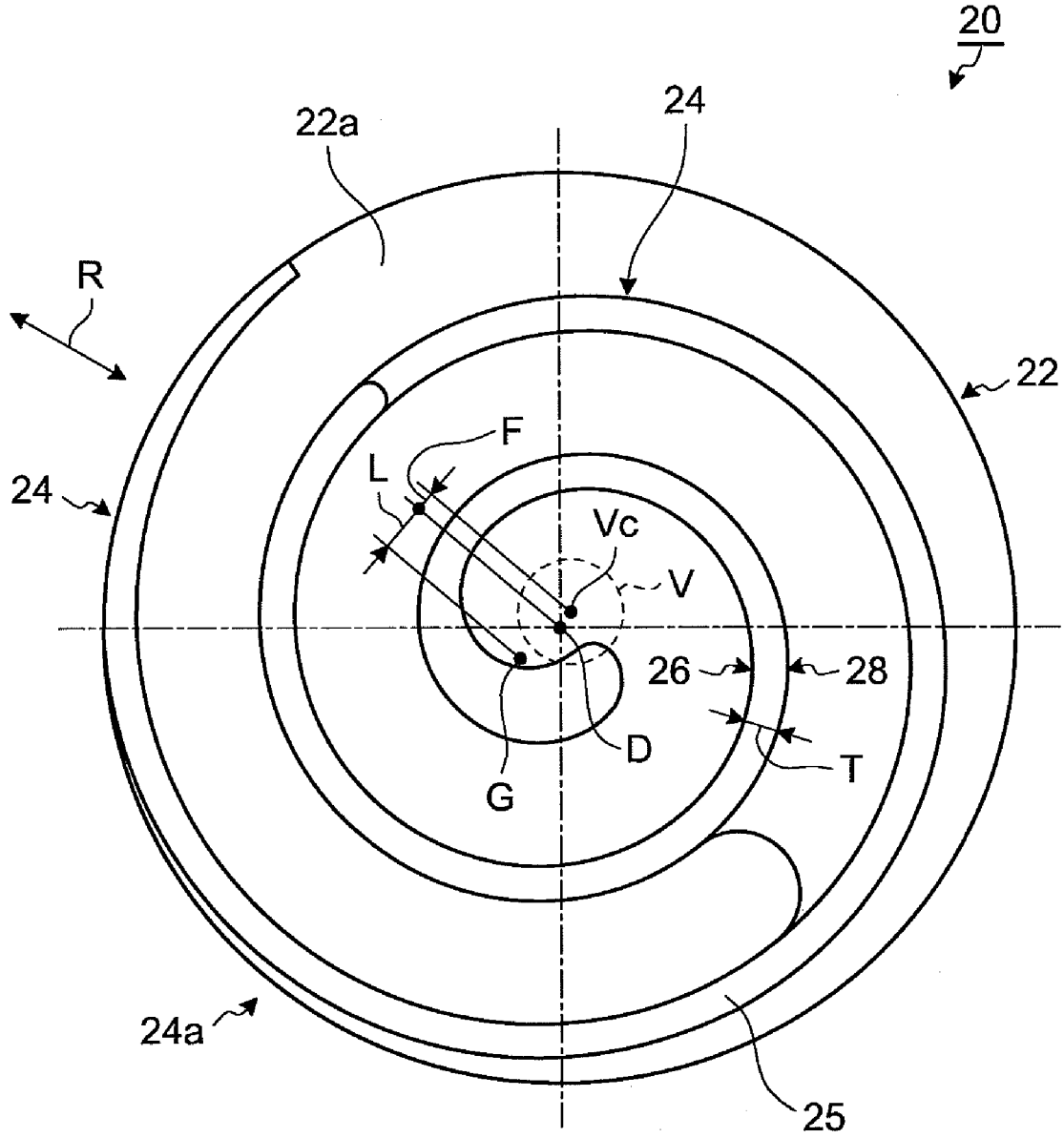
FIG. 1 is a schematic view of a turning scroll according to a first embodiment of the present invention as viewed from its surface.

10 scroll compressor
12 housing
12*a* housing body
12*c* front case
12*e* thrust face
14 fixed scroll
17 chip face
18 fixed scroll body
20, 20B, 20C turning scroll
22, 22*c* end plate
23 backside of end plate
24, 24B turning scroll body
24*a*, 52 outermost circumferential portion
25 seal member
27 chip face
30 input shaft
34 drive pin
40 autorotation preventing pin
43 ring hole
44 autorotation preventing ring
50, 70 concave
66 outer edge

BEST MODE(S) FOR CARRYING OUT THE INVENTION

Embodiments of the present invention will be explained in detail below with reference to the accompanying drawings. It is noted that the present invention is not limited to the embodiments. In addition, components in the following embodiments will include those which can easily be thought of by persons skilled in the art or which are substantially equivalents to the components.

First Embodiment

Figure 2:
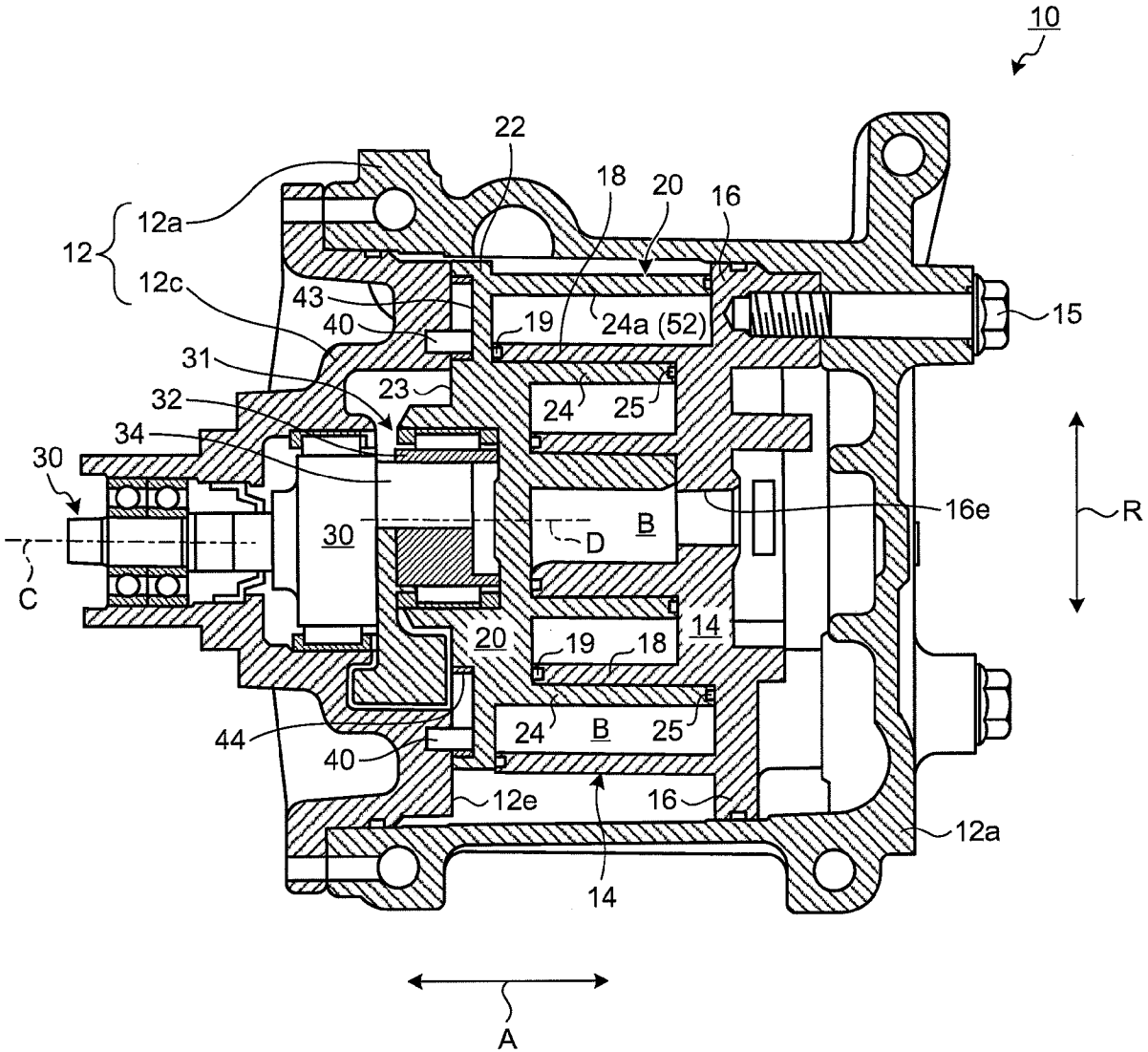
FIG. 2 is a vertical cross-sectional view showing an overall configuration of a scroll compressor according to the first embodiment.
Figure 3:
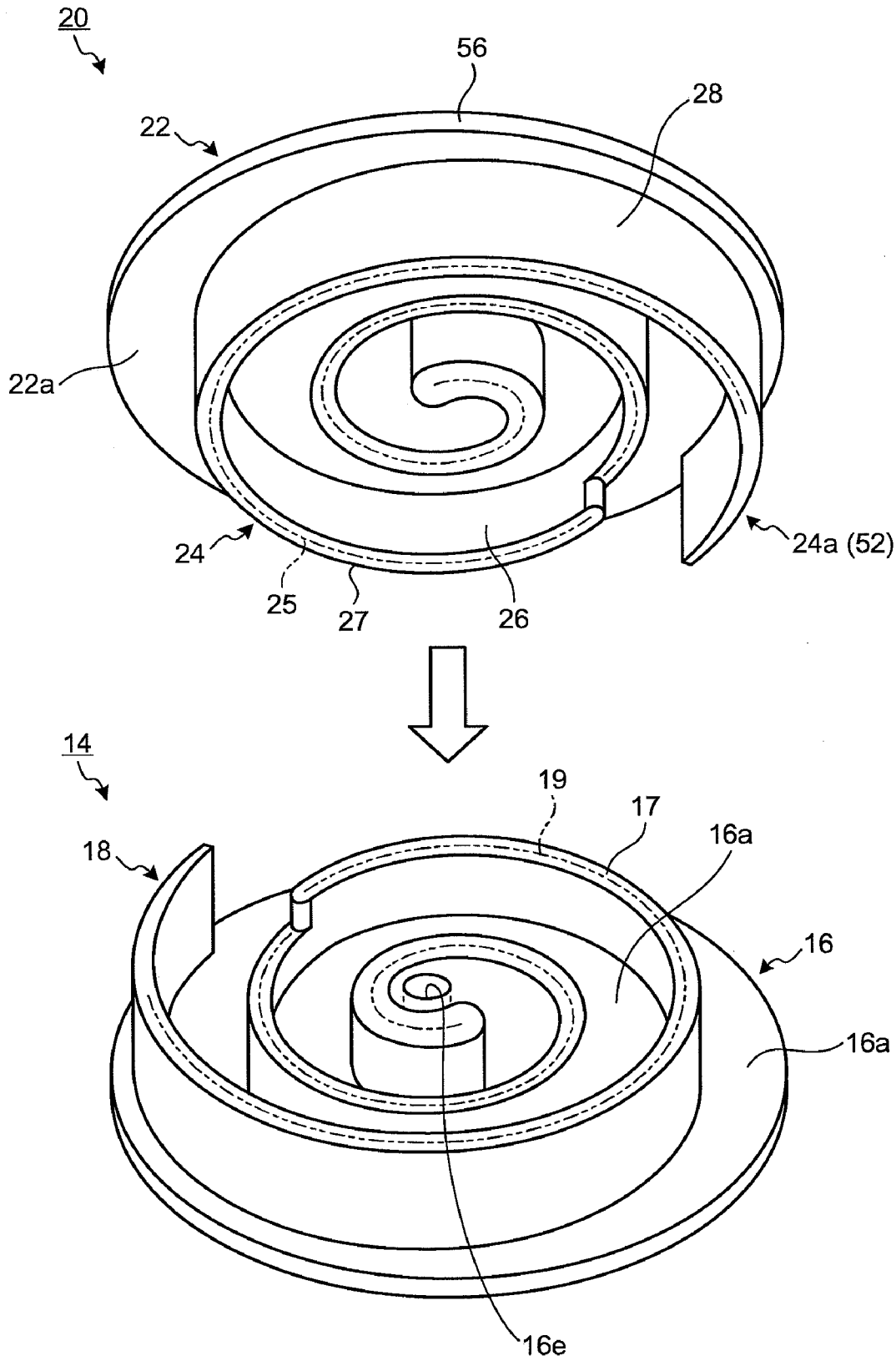
FIG. 3 is a perspective view of a fixed scroll and the turning scroll according to the first embodiment.
Figure 4:
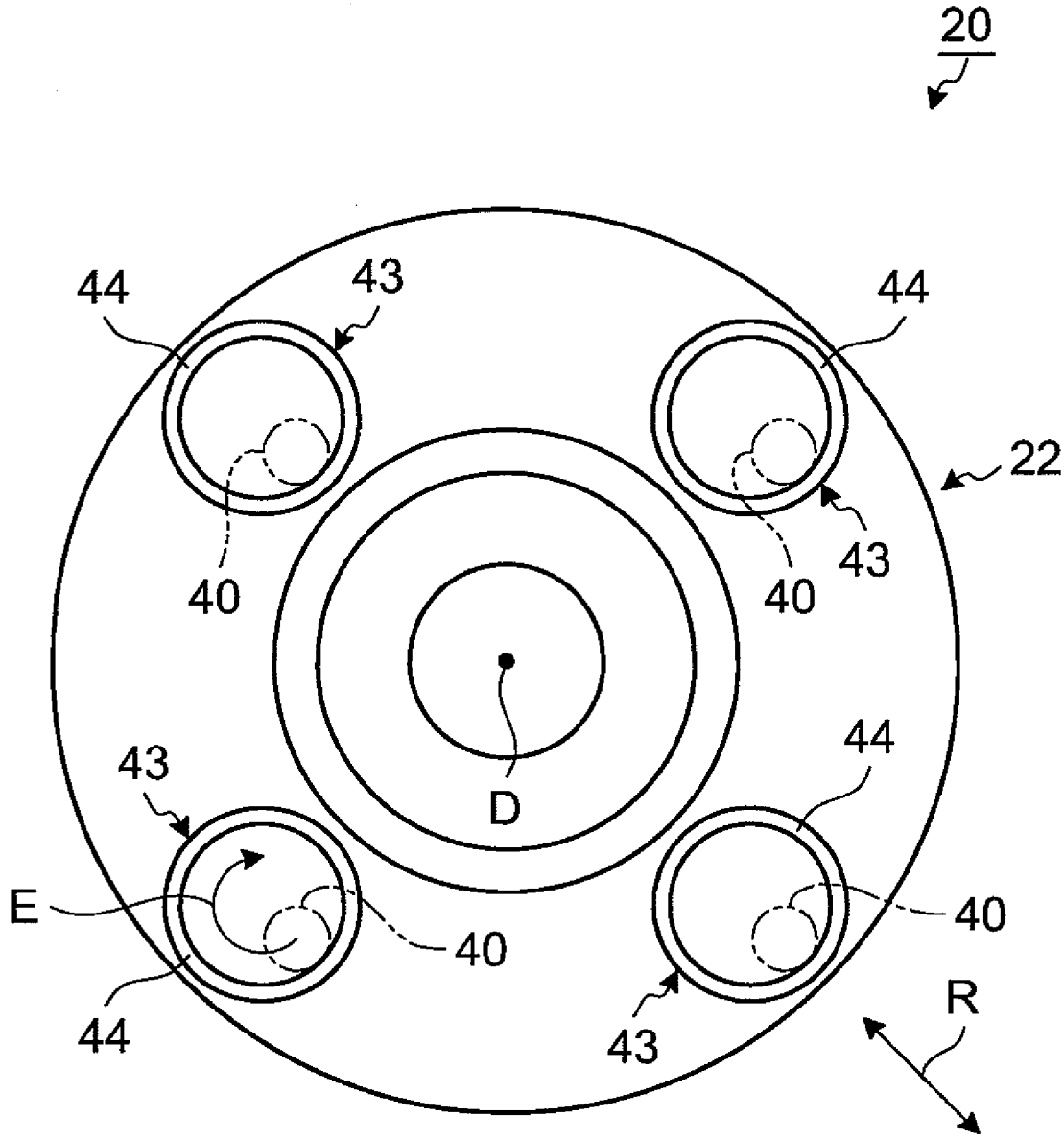
FIG. 4 is a schematic view of the turning scroll according to the first embodiment as viewed from its backside.

An overall configuration of a scroll compressor according to the present embodiment will be explained first with reference to FIG. 1 to FIG. 3. FIG. 1 is a schematic of a turning scroll as viewed from its surface. FIG. 2 is a vertical cross-section showing an overall configuration of the scroll compressor. FIG. 3 is a perspective view of a fixed scroll and the turning scroll. FIG. 4 is a schematic of the turning scroll shown in FIG. 3 as viewed from its backside.

As shown in FIG. 2, a scroll compressor 10 is provided with a fixed scroll 14 fixed to a housing 12, and a turning scroll 20 that revolves with respect to the housing 12 and the fixed scroll 14. The housing 12 is formed of a housing body 12*a* formed in a cup shape and a front case 12*c* covering an opening of the housing body 12*a*.

The fixed scroll 14 is fixed to the housing body 12*a* using a bolt 15 at an end plate 16. Meanwhile, in the turning scroll 20, an end plate 22 is supported by a revolution drive mechanism explained later, and a backside 23 of the end plate 22 contacts with a thrust face 12*e* of the front case 12*c* so as to be slidable. The turning scroll 20 is revolvable with respect to the fixed scroll 14.

As shown in FIG. 3, the fixed scroll 14 includes the end plate 16 in an approximate disk shape, and a scroll wall 18 (hereinafter, "fixed scroll body") placed upright on the end plate 16. The fixed scroll body 18 is extended in such a manner as to vertically protrude from a surface 16*a* of the end plate 16. A seal member 19 (indicated by a dashed two-dotted line in FIG. 3) is provided on a chip face 17 being an end face of the fixed scroll body 18. A discharge port 16*e* to discharge compressed air to the backside of the end plate 16 is formed at a substantial center of the end plate 16 of the fixed scroll 14.

The turning scroll 20 includes, similarly to the fixed scroll 14, the end plate 22 in an approximate disk shape and a scroll wall 24 (hereinafter, "turning scroll body") placed upright on the end plate 22. The turning scroll body 24 is extended in such a manner as to vertically protrude from a surface 22*a* of the end plate 22. A seal member 25 (indicated by a dashed two-dotted line in FIG. 3) is provided on a chip face 27 being an end face of the turning scroll body 24. Numeral 56 represents a side face of the end plate 22. Numerals 26 and 28 represent side faces of the turning spiral element 24.

In the turning scroll 20, as shown in FIG. 1, the turning scroll body 24 has a shape similar to an involute curve (involute) of a circle. It is noted that a shape of the fixed scroll body 18 of the fixed scroll 14 is one obtained by inverting the shape of the turning scroll body 24 by 180 degrees in the radial direction, and shapes of the other parts are substantially common to those of the element 24.

As shown in FIG. 3, the turning scroll 20 and the fixed scroll 14 are provided in the housing 12 so that the turning scroll body 24 is engaged with the fixed scroll body 18. In such a state as above, the seal member 25 of the turning scroll body 24 is in contact with the surface 16*a* of the end plate 16, and the seal member 19 of the fixed scroll body 18 is in contact with the surface 22*a* of the end plate 22 of the turning scroll 20. Thus, a plurality of compression spaces B is formed between the turning scroll 20 and the fixed scroll 14.

When the turning scroll 20 is driven so as to revolve with respect to the fixed scroll 14, the compression spaces B move inwardly in a radial direction R, the volume thereof decreases and the pressure increases, and gas in the compression spaces B is thereby compressed. The compressed gas is discharged from the discharge port 16*e* formed in the end plate 16 of the fixed scroll 14.

Further, as a revolving mechanism that drives the turning scroll 20 so as to revolve with respect to the fixed scroll 14, the scroll compressor 10 includes an input shaft 30 (in the figure, a shaft center is indicated by a dashed one-dotted line C, and an axial direction is indicated by arrow A) into which mechanical power is input from the outside, a bush 32 that rotatably supports the turning scroll 20 through a bearing 31, and a drive pin 34 that engages between the input shaft 30 and the bush 32 to convert rotation of the input shaft 30 to revolving movement of the bush 32.

A central axis D of the end plate 22 of the turning scroll 20 and a central axis of the bush 32 coincide with each other, and hereinafter, the central axis is described "drive central axis" and is indicated by a dashed one-dotted line D. The drive pin 34 is eccentrically provided with respect to the shaft center C of the input shaft 30 and the drive central axis D. When the input shaft 30 is driven to rotate, the bush 32 i.e., the drive central axis D revolves around the shaft center C.

At this time, the bush 32 revolves with respect to the fixed scroll 14 while changing its position. On the other hand, the turning scroll 20 rotatably supported by the bush 32 is prevented from autorotation around the drive central axis D by an autorotation preventing mechanism, and thus, the turning scroll 20 revolves around the shaft center C while maintaining the position with respect to the fixed scroll 14. The revolving movement is hereinafter described "revolving". In this manner, the turning scroll 20 becomes revolvable with respect to the fixed scroll 14.

In the scroll compressor 10, as an autorotation preventing mechanism that prevents the turning scroll 20 from rotating around the drive central axis D when the turning scroll 20 is revolving around the shaft center C, a plurality of pairs of an autorotation preventing pin 40 and an autorotation preventing ring 44 is provided between the housing 12 and the turning scroll 20.

As shown in FIG. 2, a half part of the autorotation preventing pin 40 is fixed by being inserted into the thrust face 12*e* of the front case 12*c*, and the remaining half part thereof protrudes to the side of the end plate 22 of the turning scroll 20. Meanwhile, a cylindrical ring hole 43 is made in the end plate 22, and the autorotation preventing ring 44 in an annular shape is provided in the ring hole 43. The protruding portion of the autorotation preventing pin 40 is in contact with the inner side of the autorotation preventing ring 44.

As shown in FIG. 4, the autorotation preventing pin 40 and the autorotation preventing ring 44 are arranged at a predetermined interval in the circumferential direction of the central axis i.e., the drive central axis D of the end plate 22 of the turning scroll 20. When the turning scroll 20 revolves, the autorotation preventing pin 40 moves as shown by arrow E while contacting the autorotation preventing ring 44. In other words, the movement of the autorotation preventing ring 44 of the turning scroll 20 is restricted by the autorotation preventing pin 40. This restriction enables the turning scroll 20 to revolve around the shaft center C of the input shaft 30 while the turning scroll 20 is prevented from being rotated around the drive central axis D.

Figure 5:
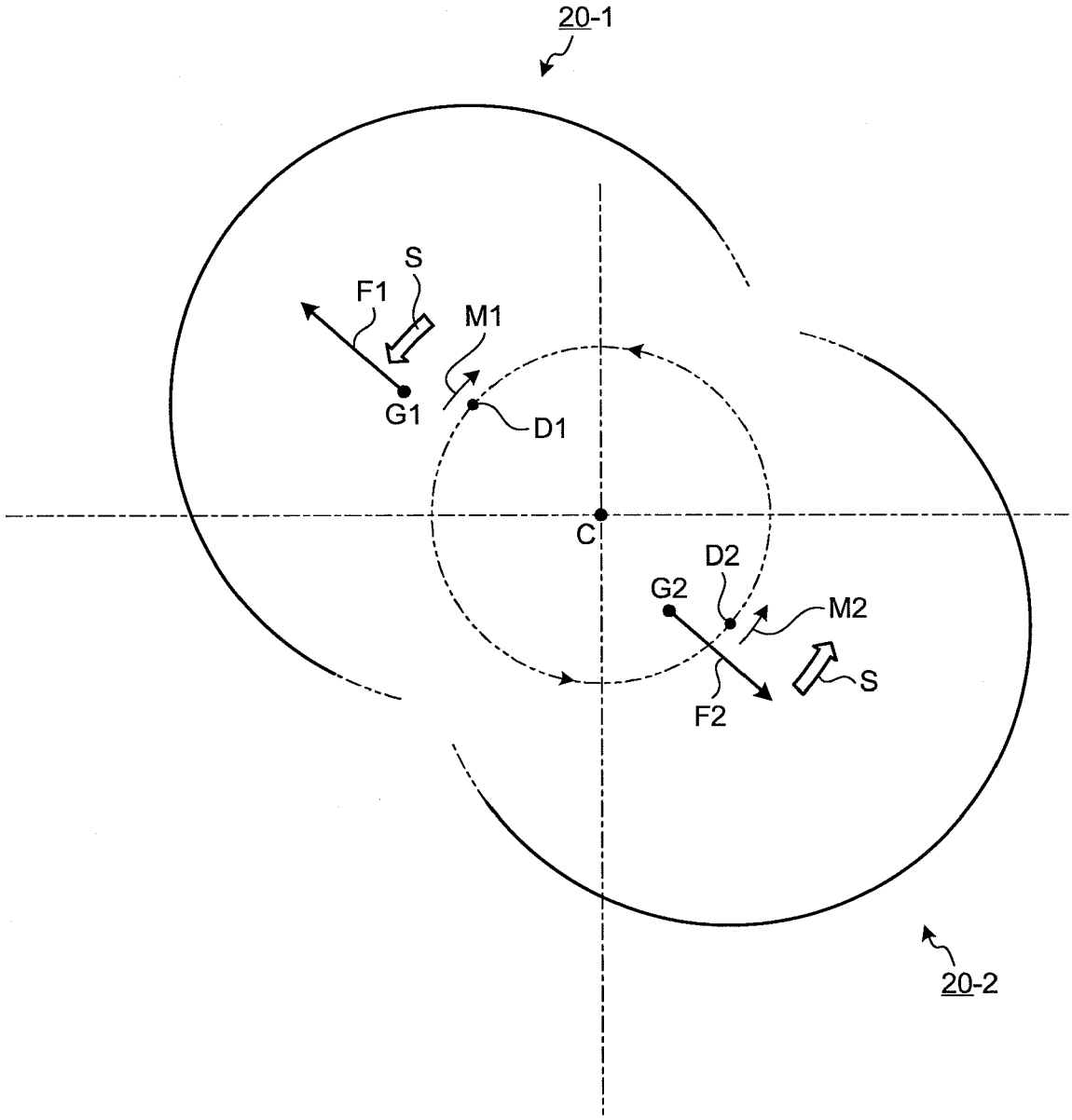
FIG. 5 is a schematic view for explaining a moment force acting on around a drive central axis during revolving of the turning scroll.

In the scroll compressor 10 as explained above, the gravity center of the turning scroll 20 deviates from the drive central axis D of the turning scroll 20, and in this case, when the turning scroll is caused to revolve, the alternating force acts on the autorotation preventing pin 40. The action is explained below with reference to FIG. 1 and FIG. 5. FIG. 5 is a schematic for explaining a moment force acting on around the drive central axis D during the revolving of the turning scroll.

As shown in FIG. 1, in the turning scroll 20, the turning scroll body 24 has a shape similar to the involute curve of a circle. A base circle of the involute curve is indicated by a dotted line V and a center of the base circle is indicated by a point Vc. The turning scroll body 24 is not a point which is symmetry with respect to the center Vc. Therefore, a gravity center G of the turning scroll 20 is shifted to the side of an outermost circumferential portion 24*a*, as compared with the central axis or the drive central axis of the end plate 22, due to the mass of the turning scroll body 24, particularly to the mass of the outermost circumferential portion 24*a*.

When the gravity center G of the turning scroll 20 is shifted from the drive central axis D in this manner, moment forces in different directions act on around the drive central axis D in the turning scroll 20 during the revolving. More specifically, as shown in FIG. 5, when the turning scroll 20 revolves around the shaft center C and the drive central axis is located at a position D1, a centrifugal force F1 acts on a gravity center G1 of a turning scroll 20-1 at this time. The action of the centrifugal force F1 causes a clockwise moment force M1 about the drive central axis D1 to be created in the turning scroll 20-1.

When the turning scroll 20 further revolves 180 degrees around the shaft center C and the drive central axis is located at a position D2, a centrifugal force F2, which is equivalent to the centrifugal force F1 and is reversely directed, acts on a gravity center G2 of a turning scroll 20-2 at this time. The action of the centrifugal force F2 causes a counterclockwise moment force M2 about the drive central axis D2 to be created in the turning scroll 20-2.

In this manner, the moment force M1 and the moment force M1 of which directions are different from each other about the drive central axis D act on the turning scroll 20 (20-1; 20-2) during the revolving. When the moment forces differently directed to each other about the drive central axis D (D1; D2) act on the turning scroll 20, force, so-called "alternating force", causing a direction to be alternately changed in the circumferential direction of the drive central axis D acts on the autorotation preventing pins 40 arranged in the circumferential direction of the drive central axis D.

In addition to the above force, a moment force S caused by a compression reaction force of gas compressed in the compression space B acts counterclockwise on the turning scroll 20 (20-1; 20-2) about the drive central axis D during the revolving. When a revolving speed of the turning scroll 20 is low and the moment force M1 and the moment force M2 are smaller than the moment force S, the moment force M1 is counterbalanced by the moment force S. Thus, when the revolving speed is low, the moment forces differently directed to each other about the drive central axis D (D1; D2) do not act on the turning scroll 20, and therefore the alternating force does not act on the autorotation preventing pins 40. However, if the revolving speed of the turning scroll 20 becomes high and the moment force M1 becomes larger than the moment force S, then the alternating force acts on the autorotation preventing pins 40 in the above manner.

When the alternating force acting on the autorotation preventing pins 40 is large, the autorotation preventing pins 40 fatigue and this may cause the strength to decrease. Therefore, in the scroll compressor 10 according to the present embodiment, the center Vc of the turning scroll body 24 is shifted with respect to the drive central axis D so that a distance between the gravity center G and the drive central axis D of the turning scroll 20 is smaller than a predetermined allowable value. The displacement is explained below with reference to FIG. 1.

In the turning scroll 20, the center Vc of the involute base circle V being the center of the turning scroll body 24 is set so as to be shifted with respect to the drive central axis D being also the central axis of the end plate 22 in the reverse direction to the direction of the outermost circumferential portion 24*a*, so that the distance (indicated by dimension L in FIG. 1) between the gravity center G and the drive central axis D of the turning scroll 20 is smaller than the predetermined allowable value set based on theoretical displacement and mass of the turning scroll.

An allowable value Lg of the distance L between the gravity center G and the drive central axis D is calculated by a following equation based on a mass Msc [g] of the turning scroll 20 and a theoretical displacement volume Vth [ml/rev] of the scroll compressor 10.

$$Lg=9\times Vth/Msc$$

It is noted that the mass of the turning scroll 20 includes the mass of the seal member 25 and the mass of the bearing 31.

By setting the center Vc of the turning scroll body 24 so as to satisfy the conditions, a distance (indicated by dimension F in FIG. 1) in which the center Vc is shifted with respect to the drive central axis D becomes about 1 to 2 mm when a diameter of the end plate 22 of the turning scroll 20 is 85 mm to 105 mm. By thus setting the center Vc, the gravity center G of the turning scroll 20 is brought close to the drive central axis D. This enables to reduce the moment force acting on the turning scroll 20 during the revolving and to reduce the alternating force acting on the autorotation preventing pins 40 to an allowable level.

As explained above, in the present embodiment, the center Vc of the involute base circle V which is the center of the turning scroll body 24 of the turning scroll 20 is shifted with respect to the drive central axis D so that the distance between the gravity center G and the drive central axis D of the turning scroll 20 is smaller than the predetermined allowable value set based on the theoretical displacement volume and the mass of the turning scroll. In this manner, the gravity center G of the turning scroll 20 is brought close to the drive central axis D. This enables the moment force about the drive central axis D acting on the turning scroll 20 to be reduced during the revolving, and also enables the alternating force acting on the autorotation preventing pins 40 to be reduced to the allowable level. As a result, the reliability of the scroll compressor can be improved without loosening and breaking the autorotation preventing pins 40.

Second Embodiment

Figure 6:
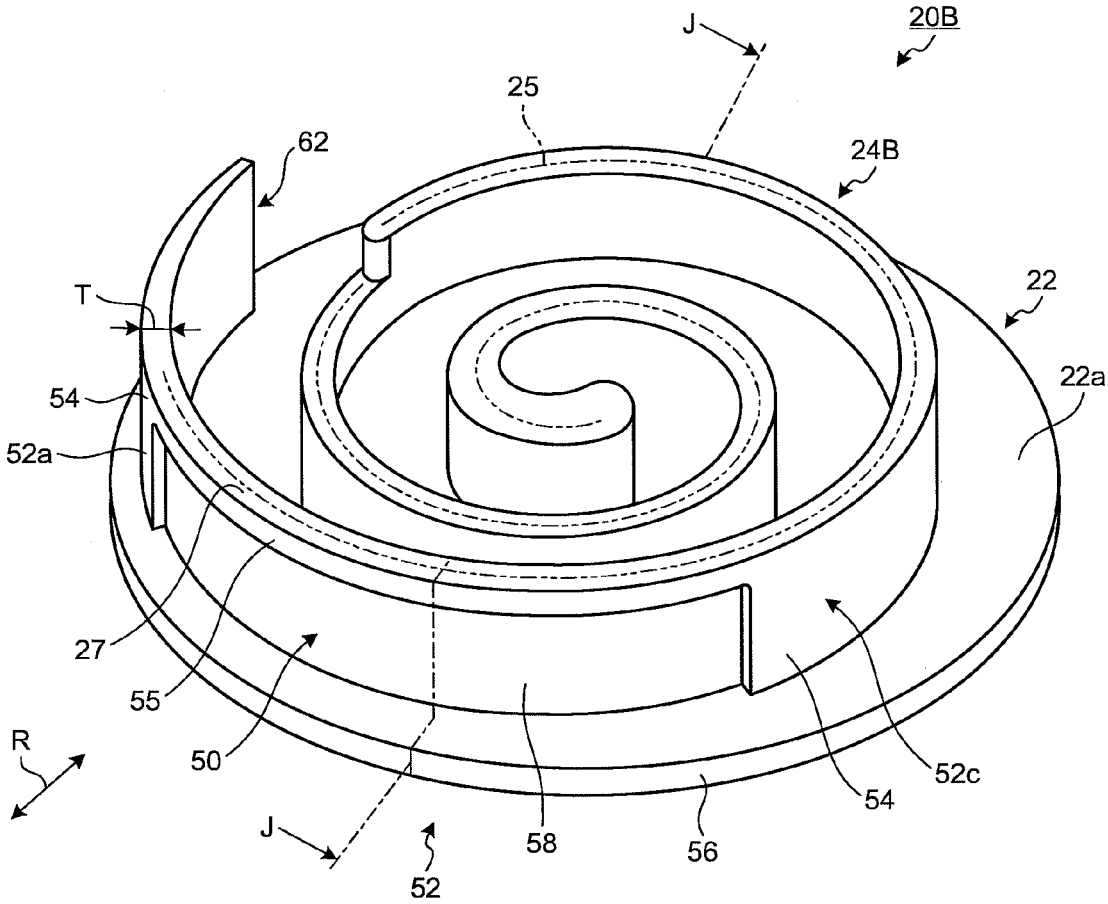
FIG. 6 is a perspective view of a turning scroll according to a second embodiment of the present invention.
Figure 7:
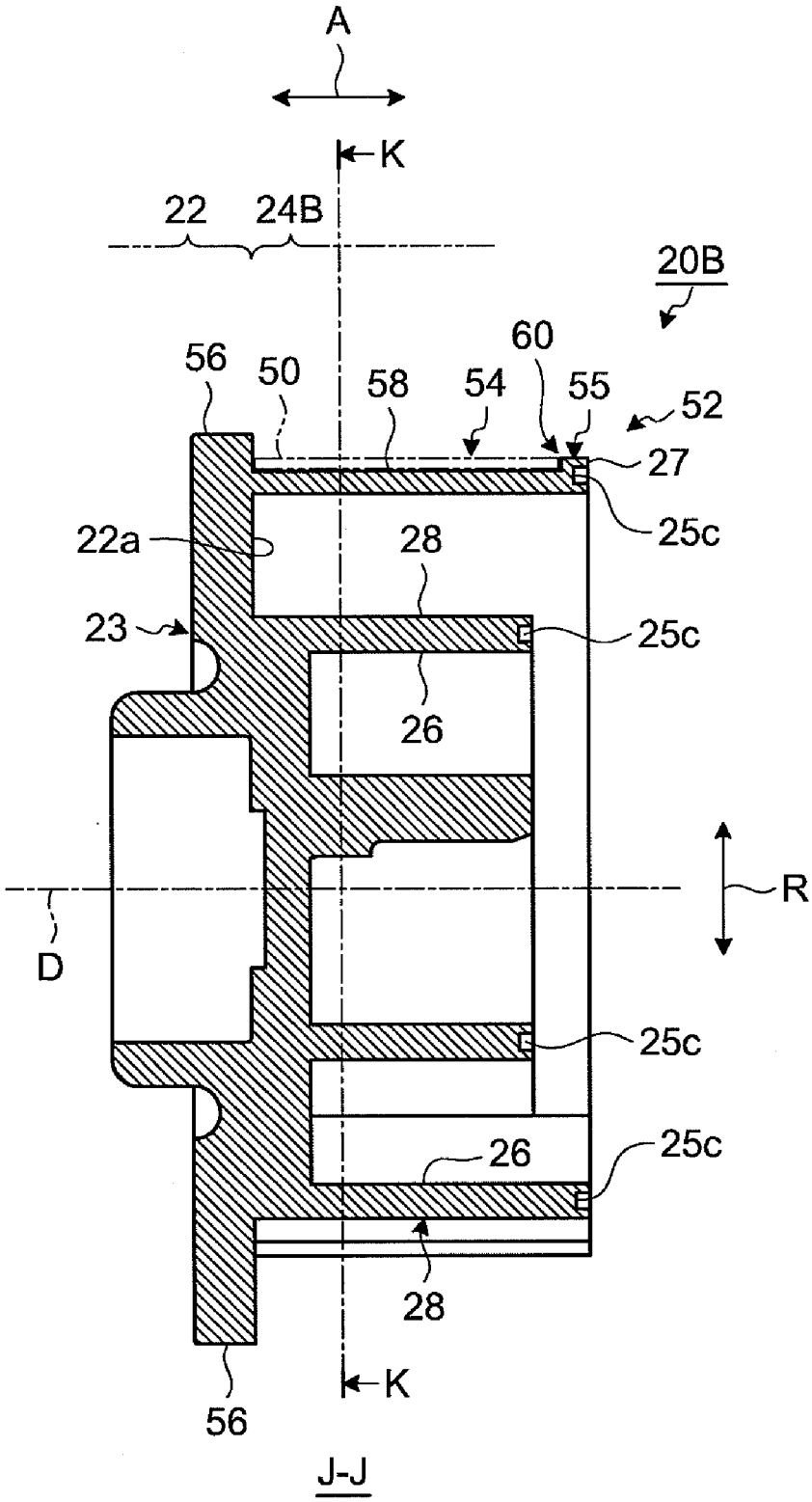
FIG. 7 is a cross sectional view taken along the line J-J of FIG. 6.
Figure 8:
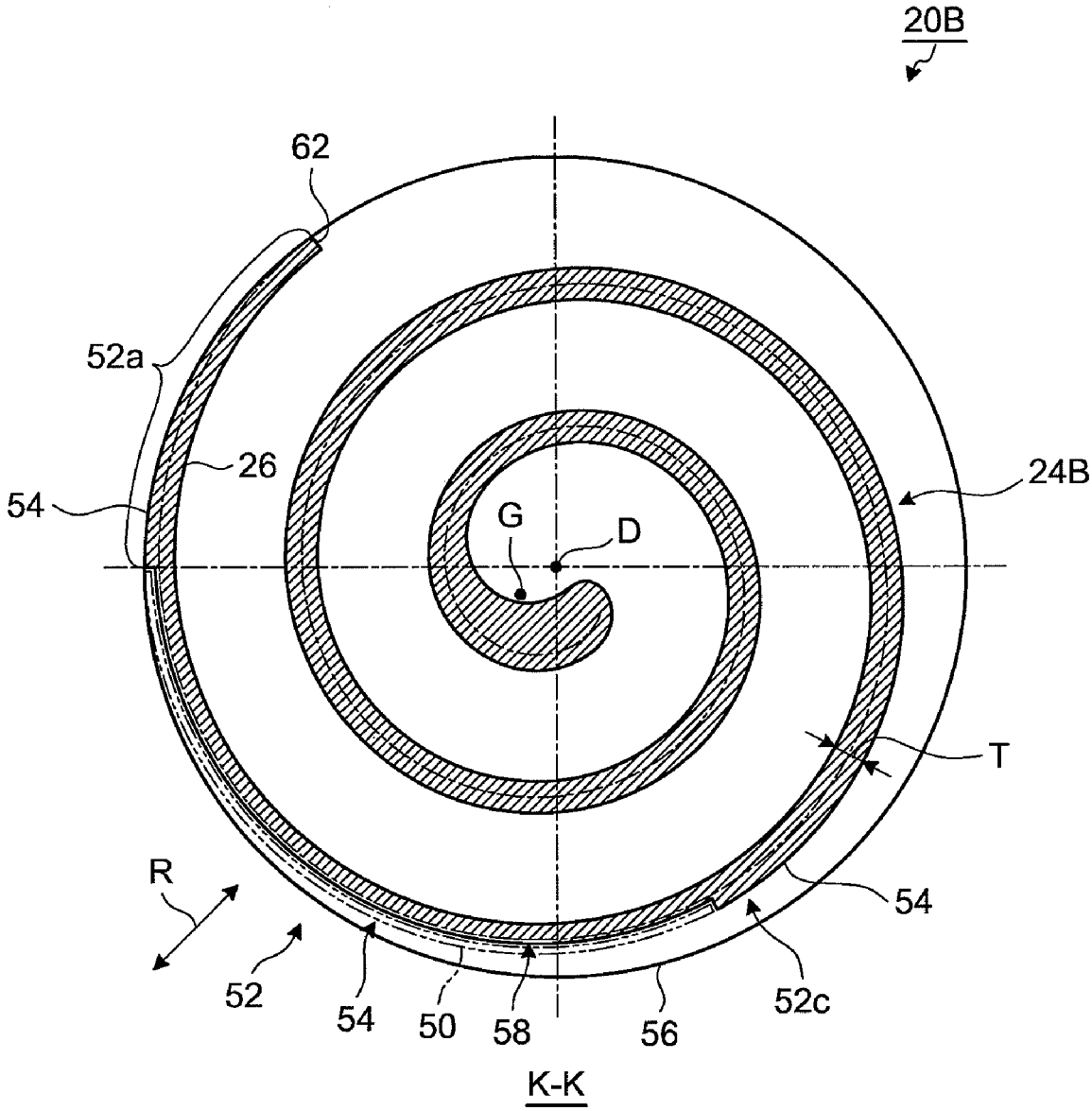
FIG. 8 is a cross sectional view taken along the line K-K of FIG. 7.

A scroll compressor according to a present embodiment will be explained below with reference to FIG. 2 and FIG. 6 to FIG. 8. FIG. 6 is a perspective view of a turning scroll, FIG. 7 is a cross section taken along the line J-J of FIG. 6, and FIG. 8 is a cross section taken along the line K-K of FIG. 7. The scroll compressor according to the present embodiment is different from the scroll compressor according to the first embodiment in that a concave is formed along an outer surface of a turning scroll body of the turning scroll, which will be explained in detail below. It is noted that same letters or numerals are assigned to components substantially common to these of the scroll compressor according to the first embodiment, and explanation thereof is omitted.

As shown in FIG. 6, a turning scroll 20B according to the present embodiment has a concave (cavity) 50 formed along an outer surface 54 of an outermost circumferential portion 52 of a turning scroll body 24B. The concave 50 is formed so as to concave inward from the outer surface 54 of the outermost circumferential portion 52 in the radial direction R. Specifically, a portion where the concave 50 is formed, of the outermost circumferential portion 52 of the turning scroll body 24B, is formed by scraping away its wall to be thinned as compared with adjacent portions 52*a* and 52*c*. By forming the concave 50 in this manner, a predetermined location of the outermost circumferential portion 52 of the turning scroll body 24B is reduced in weight. With this feature, the gravity center G of the turning scroll 20B is brought close to the drive central axis D as much as possible. The outer surface 54 of the outermost circumferential portion 52 of the turning scroll body 24B is not engaged with the fixed scroll body 18, unlike as shown in FIG. 1 and FIG. 2. Therefore, by forming the concave 50 in the outer surface 54 of the outermost circumferential portion 52, the gravity center G of the turning scroll 20B can be brought close to the drive central axis D without affecting on formation of the compression space B.

As shown in FIG. 7, the concave 50 is formed in the outermost circumferential portion 52 of the turning scroll body 24B except an edge portion 55 adjacent to the chip face 27, and is extended in the direction along the drive central axis D. A step 60 is formed between a bottom face 58 of the concave 50 and the edge portion 55. By forming the concave 50 except the edge portion 55 in this manner, the gravity center G of the turning scroll 20B can be brought close to the drive central axis D while a tooth thickness T enabling to form a groove 25*c* holding the seal member 25 therein is ensured in the edge portion 55. It is noted that the concave 50 may not only be provided in the turning scroll body 24B but may also be extended up to the end plate 22 so as to be engaged therein.

As shown in FIG. 8, the concave 50 is formed on the side in which the gravity center G is displaced with respect to the drive central axis D, of the outermost circumferential portion 52 of the turning scroll body 24B. This allows the gravity center G of the turning scroll 20B to be efficiently brought close to the drive central axis D. The concave 50 is not formed in the portion 52*a* including an end 62, of the turning scroll body 24B. This is because the portion 52*a* has a tooth thickness thinner as compared with that of the other portion of the outermost circumferential portion 52, and even if the concave 50 is formed in the portion 52*a*, this does not contribute so much to bringing the gravity center G of the turning scroll 20B close to the drive central axis D. By forming the concave 50 except the portion 52*a* having the end 62 in this manner, the gravity center G of the turning scroll 20B can be brought close to the drive central axis D while the rigidity of the turning scroll body 24B is ensured.

As explained above, in the present embodiment, the concave 50 is formed in the outer surface 54 of the outermost circumferential portion 52 of the turning scroll body 24B. By forming the concave 50 in this manner to reduce the weight of the predetermined location in the outermost circumferential portion 52, the gravity center G of the turning scroll 20B can be brought close to the drive central axis. This enables to reduce the moment force about the drive central axis D acting on the turning scroll 20B during the revolving and to reduce the alternating force acting on the autorotation preventing pins 40. As a result, the reliability of the scroll compressor can be improved without loosening and breaking the autorotation preventing pins 40.

Third Embodiment

Figure 9:
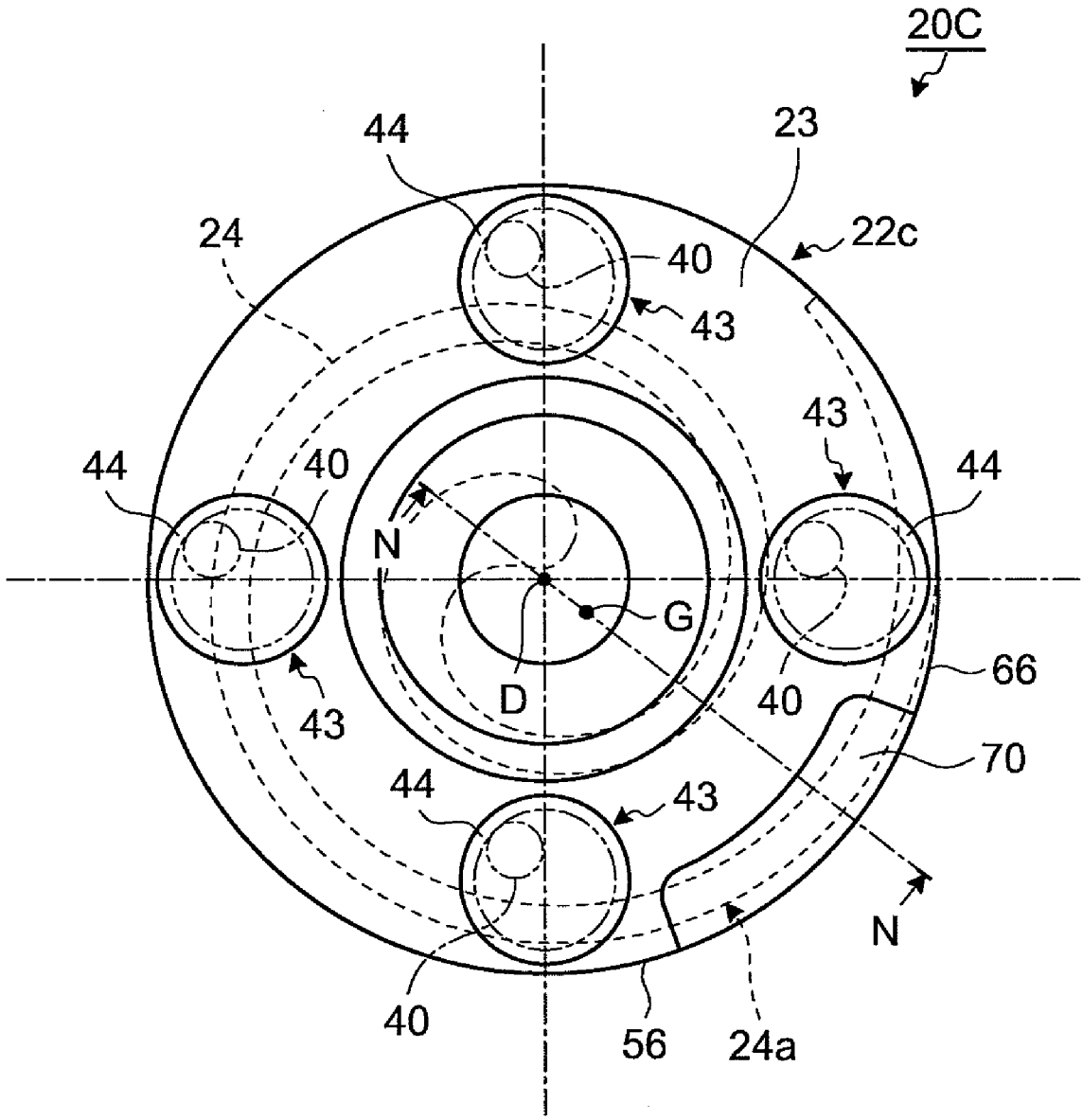
FIG. 9 is a schematic view of an end plate of a turning scroll according to a third embodiment of the present invention as viewed from its backside.
Figure 10:
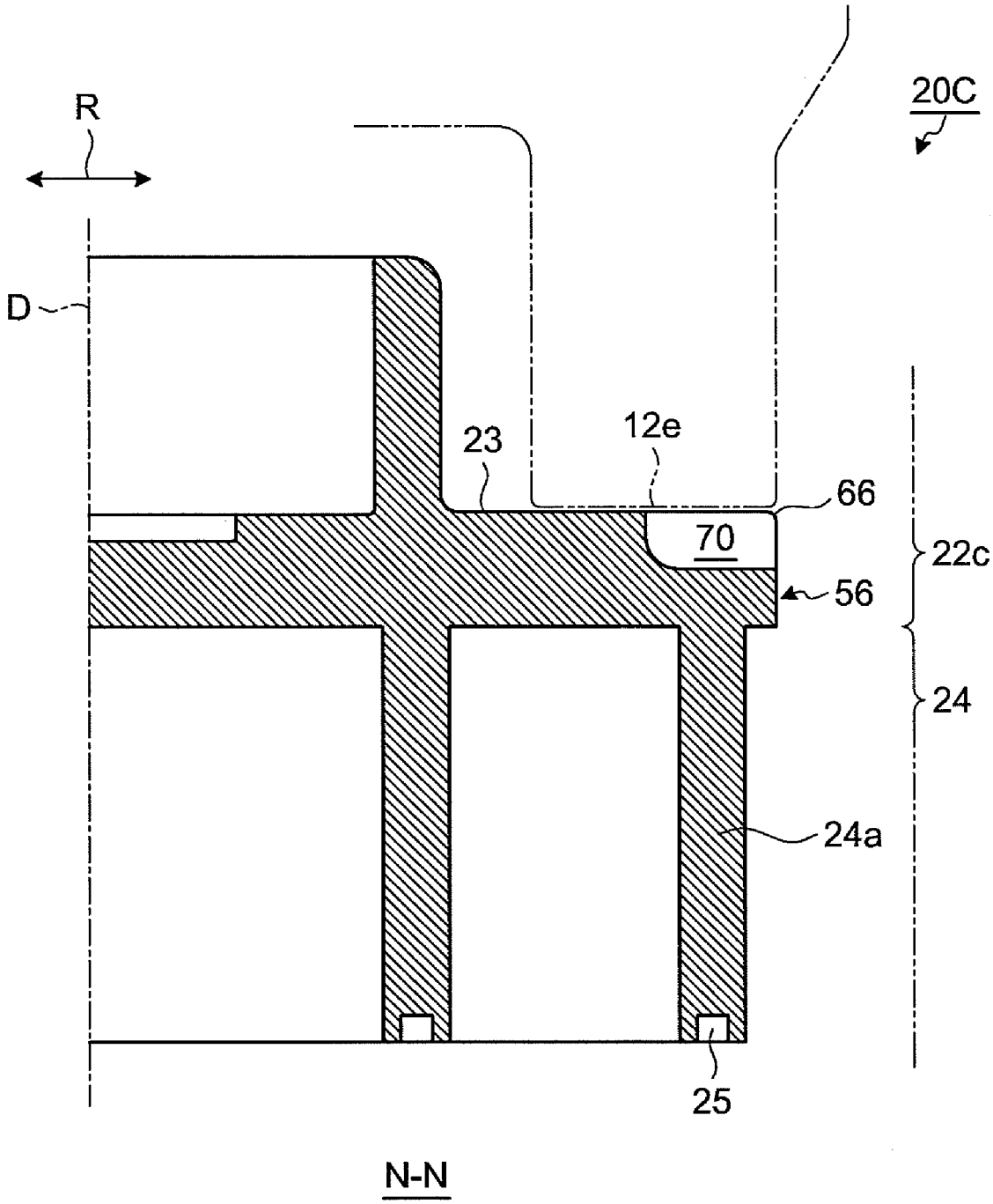
FIG. 10 is a cross sectional view taken along the line N-N of FIG. 9.

A scroll compressor according to a present embodiment will be explained below with reference to FIG. 9 and FIG. 10. FIG. 9 is a schematic of an end plate of a turning scroll as viewed from its backside, and FIG. 10 is a cross section taken along the line N-N of FIG. 9. The scroll compressor according to the present embodiment is different from the scroll compressor according to the first embodiment in that a concave is formed in the end plate of the turning scroll, which will be explained in detail below. It is noted that same letters or numerals are assigned to components substantially common to these of the scroll compressor according to the first embodiment, and explanation thereof is omitted.

As shown in FIG. 9, a turning scroll 20C according to the present embodiment has a concave (cavity) 70 formed along an outer edge 66 on the backside 23 of an end plate 22*c*. The concave 70 is provided in a location corresponding to the outermost circumferential portion 24*a* of the turning scroll body 24. More specifically, the concave 70 is formed on the side, of the end plate 22*c*, in which the gravity center G of the turning scroll 20C is shifted with respect to the drive central axis D being the center of the end plate 22*c*. By forming the concave 70 in this manner to reduce the weight thereof, the gravity center G of the turning scroll 20C can be brought close to the drive central axis D without changing the shape of the turning scroll body 24.

As shown in FIG. 10, the concave 70 is formed so as to concave from the backside 23 of the end plate 22*c* toward the turning scroll body 24 in the direction along the drive central axis D. In other words, the concave 70 is formed so as to concave inward in the radial direction R from the side face 56 of the end plate 22*c*. The side face 56 of the end plate 22*c* in the turning scroll 20C does not contact the housing 12, unlike as shown in FIG. 2. In addition, the backside 23 of the end plate 22*c* is a sliding contact surface with the thrust face 12*e* of the housing 12, and even if the concave 70 is formed, the sliding contact surface only slightly decreases. Therefore, by providing the concave 70 along the outer edge 66 on the backside 23 of the end plate 22*c*, the gravity center G of the turning scroll 20C can be brought close to the drive central axis D without affecting on the specification of the scroll compressor.

As explained above, in the present embodiment, the concave 70 is formed along the outer edge 66 of the end plate 22*c* in the turning scroll 20C. By forming the concave 70 in this manner to reduce the weight, the gravity center G of the turning scroll 20C can be brought close to the drive central axis D without changing the shape of the turning scroll body 24. This enables to reduce the moment force about the drive central axis D acting on the turning scroll 20C during the revolving and to reduce the alternating force acting on the autorotation preventing pins 40. As a result, the reliability of the scroll compressor can be improved without loosening and breaking the autorotation preventing pins 40.

In the embodiments, the fixed scroll body 18 and the turning scroll body (24; 24B) have the shape similar to the involute curve of the circle, however, the shape of the scroll body is not limited thereto. For example, even if the scroll body has a shape along an involute curve of a regular polygon, the present invention can also be applied to the scroll body.

It is also preferred to first set so that the center of the turning scroll body is shifted with respect to the drive central axis, and further to form a concave in the outer surface of the outermost circumferential portion of the turning scroll body or to form a concave along the outer edge of the end plate of the turning scroll. The gravity center G of the turning scroll can thereby be brought closer to the drive central axis D.

INDUSTRIAL APPLICABILITY

As explained above, the present invention is useful for the scroll compressor in which autorotation around the drive central axis of the turning scroll is prevented by the pins.

The invention claimed is:

1. A scroll compressor comprising:

a fixed scroll in which a fixed scroll body being a scroll wall is placed upright on an end plate;

a turning scroll in which a turning scroll body being a scroll wall is placed upright on an end plate, the turning scroll forming a compression space in a state in which the turning scroll body is engaged with the fixed scroll body; and a plurality of pins for allowing the turning scroll to revolve with respect to the fixed scroll while preventing the turning scroll from an autorotation around a center of a drive central axis, wherein a center of the turning scroll body which is a gravity center of the turning scroll is shifted with respect to the drive central axis, so that a distance between the center of gravity and the drive central axis in the turning scroll becomes smaller than a predetermined allowable value set based on a theoretical displacement volume and a mass of the turning scroll, wherein the predetermined allowable value is calculated by the equation $Lg=9\times Vth/Msc$, where Lg is the allowable value of the distance between the center of gravity and the drive central axis, Msc [g] is a mass of the turning scroll, and Vth [ml/rev] is a theoretical displacement volume of the scroll compressor.

2. The scroll compressor according to claim 1, wherein the center of the turning scroll body is shifted with respect to the drive central axis.

3. The scroll compressor according to claim 1, wherein a concave is formed in an outer surface of an outermost circumferential portion of the turning scroll body.

4. The scroll compressor according to claim 1, wherein a concave is formed along an outer edge of the end plate of the turning scroll.

5. A scroll compressor comprising:

a fixed scroll in which a fixed scroll body being a scroll wall is placed upright on an end plate;

a turning scroll in which a turning scroll body being a scroll wall is placed upright on an end plate, the turning scroll forming a compression space in a state in which the turning scroll body is engaged with the fixed scroll body; and a plurality of pins for allowing the turning scroll to revolve with respect to the fixed scroll while preventing the turning scroll from an autorotation around a center of a drive central axis, wherein a concave is formed in an outer surface of an outermost circumferential portion of the turning scroll body so that a distance between a center of gravity and the drive central axis in the turning scroll becomes smaller than a predetermined allowable value set based on a theoretical displacement volume and a mass of the turning scroll.

6. A scroll compressor comprising:

a fixed scroll in which a fixed scroll body being a scroll wall is placed upright on an end plate;

a turning scroll in which a turning scroll body being a scroll wall is placed upright on an end plate, the turning scroll forming a compression space in a state in which the turning scroll body is engaged with the fixed scroll body; and a plurality of pins for allowing the turning scroll to revolve with respect to the fixed scroll while preventing the turning scroll from an autorotation around a center of a drive central axis, wherein a concave is formed along an outer edge of the end plate of the turning scroll so that a distance between a center of gravity and the drive central axis in the turning scroll becomes smaller than a predetermined allowable value set based on a theoretical displacement volume and a mass of the turning scroll.

* * * * *